US011484933B2

(12) United States Patent
Terada et al.

(10) Patent No.: US 11,484,933 B2
(45) Date of Patent: Nov. 1, 2022

(54) MANUFACTURING DEVICE AND MANUFACTURING METHOD FOR COMPONENT HAVING HAT-SHAPED SECTION

(71) Applicant: TOYOTA JIDOSHA KABUSHIKI KAISHA, Toyota (JP)

(72) Inventors: Eiji Terada, Nagoya (JP); Akihiro Shiochi, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 1 day.

(21) Appl. No.: 16/821,540

(22) Filed: Mar. 17, 2020

(65) Prior Publication Data

US 2020/0316673 A1 Oct. 8, 2020

(30) Foreign Application Priority Data

Apr. 4, 2019 (JP) ..... JP2019-071884

(51) Int. Cl.

| | |
|---|---|
| ***B21J 5/02*** | (2006.01) |
| ***B21D 28/34*** | (2006.01) |
| ***B21D 53/88*** | (2006.01) |
| ***B21D 22/26*** | (2006.01) |
| ***B21D 24/04*** | (2006.01) |
| ***B21D 45/02*** | (2006.01) |

(52) U.S. Cl.

CPC ..... *B21J 5/02* (2013.01); *B21D 22/26* (2013.01); *B21D 24/04* (2013.01); *B21D 28/34* (2013.01); *B21D 45/02* (2013.01); *B21D 53/88* (2013.01)

(58) Field of Classification Search

CPC ..... B21D 22/26; B21D 37/12; B21D 22/22

See application file for complete search history.

(56) References Cited

U.S. PATENT DOCUMENTS

| | | | |
|---|---|---|---|
| 2015/0224563 A1 | 8/2015 | Aso et al. | |
| 2016/0221068 A1* | 8/2016 | Tanaka | B21J 5/02 |
| 2016/0271682 A1 | 9/2016 | Tanaka et al. | |

FOREIGN PATENT DOCUMENTS

| | | | |
|---|---|---|---|
| CN | 105013918 A | * | 11/2015 |
| CN | 105013918 A | | 11/2015 |

(Continued)

OTHER PUBLICATIONS

JP-2017170482-A Google Patents Machine translation. Obtained Jun. 7, 2021.*

*Primary Examiner* — Adam J Eiseman
*Assistant Examiner* — P Derek Pressley
(74) *Attorney, Agent, or Firm* — Oliff PLC

(57) ABSTRACT

A manufacturing device manufactures a component having a hat-shaped section as a pad and a punch sandwiching a center portion of a metal plate, and a die and a holder sandwiching both side portions of the metal plate are moved relative to each other in the upper-lower direction. The manufacturing device includes the die, the pad provided inside an opening of the die so that the pad is able to move relative to the die, the punch arranged to face the pad in the upper-lower direction, the holder arranged around the punch so as to face the die in the upper-lower direction and be able to move downwardly, and a locking block provided on the holder. The locking block is moved from a non-facing position to a facing position and inserted between the pad and the holder after mold closing and before mold opening.

11 Claims, 16 Drawing Sheets

(56) References Cited

FOREIGN PATENT DOCUMENTS

| | | | | | |
|---|---|---|---|---|---|
| EP | 3722018 | A1 | * | 10/2020 | ..... B21D 24/12 |
| JP | 2017170482 | A | * | 9/2017 | |
| WO | 2014/042067 | A1 | | 3/2014 | |
| WO | 2015/046023 | A1 | | 4/2015 | |
| WO | 2015/060202 | A1 | | 4/2015 | |

* cited by examiner

MANUFACTURING DEVICE AND MANUFACTURING METHOD FOR COMPONENT HAVING HAT-SHAPED SECTION

INCORPORATION BY REFERENCE

The disclosure of Japanese Patent Application No. 2019-071884 filed on Apr. 4, 2019 including the specification, drawings and abstract is incorporated herein by reference in its entirety.

BACKGROUND

1. Technical Field

The disclosure relates to a manufacturing device and a manufacturing method for a component having a hat-shaped section.

2. Description of Related Art

When, for example, a component having a hat-shaped section in a vehicle skeleton member, such as a front-side member, is manufactured, a manufacturing device having a die, a pad, a punch, and a holder is usually used to perform pressing (drawing) of a metal plate so that the metal plate is formed to have a hat-shaped section.

To be more specific, the manufacturing device is prepared that includes the die, the pad, the punch, and the holder. In the die, an opening that opens downwardly is formed. The pad is provided inside the opening so that the pad is able to move upwardly relative to the die against downward energizing force. The punch is arranged to face the pad in an upper-lower direction. The holder is provided around the punch so that the holder faces the die in the upper-lower direction and also is able to move downwardly against upward energizing force. Then, the metal plate is placed on upper surfaces of the holder and the punch, and the die and the pad are lowered towards the holder and the punch in order to perform mold closing. Then, the pad and the punch that sandwich a center portion of the metal plate in the upper-lower direction, and a die surface and the holder that sandwich both side portions of the metal plate in the upper-lower direction move relative to each other in the upper-lower direction. Also, the punch enters the opening of the die while pushing the pad upwardly into the opening. Thus, the component having the hat-shaped section is formed. In the component having the hat-shaped section, the center portion serves as a top plate, the both side portions serve as flanges, respectively, and portions stretched between the center portion and the both side portions serve as vertical walls, respectively.

However, the manufacturing device has a following problem. When the die is moved upwardly at the time of mold release (when the mold is opened), the punch comes out of the opening of the die, and the pad moves downwardly relative to the die inside the opening of the die due to the energizing force. Meanwhile, the holder moves upwardly around the punch due to the energizing force. Then, the punch moves away from a lower surface of the top plate, and pressurizing force of the pad generated by the energizing force acts on the top plate from above, the top plate losing a support of the punch from below. At the same time, pressurizing force of the holder generated by the energizing force acts on the flanges from below. Therefore, the component having the hat-shaped section is compressed in the upper-lower direction by pressurization from the pad and the holder, and the component having the hat-shaped section may be deformed in a form that the vertical walls buckle.

Therefore, for example, WO 2015060202 discloses a manufacturing device for a component having a hat-shaped section. The manufacturing device includes a pressurization limit portion (a floating block), and a hold release portion. At the time of mold release, the pressurization limit portion moves together with a holder and is placed between a pad and the holder so that pressurization of the component having the hat-shaped section by the pad and the holder is limited. The hold release portion allows the pressurization limit portion to move relative to the holder when the holder moves by a given distance.

SUMMARY

In the manufacturing device described in WO 2015060202, the floating block is provided on top of a base board located below the holder, is inserted into a block upper-part through-hole formed in the holder, is integrated with the holder at a bottom dead point of forming, and is placed between the pad and the holder so that pressurization of the component having the hat-shaped section by the pad and the holder is limited. Meanwhile, when the die reaches a top dead point and the pad is moved away from the floating block, then the floating block is disengaged from the holder by the hold release portion, falls inside the block upper-part through-hole, and is returned to a given position on the base board.

As described above, in the manufacturing device described in WO 2015060202, the floating block is placed between the pad and the holder, and it is thus possible to inhibit deformation of the component having the hat-shaped section at the time of mold release. However, it is inevitable that a complex mechanism be provided. In this regard, there is a room for improvement.

The disclosure has been accomplished in view of this, and an object of the disclosure is to provide a technology that inhibits deformation of a component having a hat-shaped section with a simple configuration at the time of mold release when the component having the hat-shaped section is formed by pressing.

In order to achieve the above object, in a manufacturing device and a manufacturing method for a component having a hat-shaped section according to the disclosure, a block is inserted between a pad and a holder. Thus, the block receives pressurizing force from the pad and the holder generated by energizing force, the pressurizing force being supposed to act on the component having the hat-shaped section at the time of mold release. Therefore, the pressurizing force does not act on the component having the hat-shaped section.

Specifically, the disclosure is applied to a manufacturing device for a component having a hat-shaped section. The manufacturing device is used to manufacture the component having the hat-shaped section as a pad and a punch that sandwich a center portion of a metal plate in a first direction, and a die and a holder that sandwich both side portions of the metal plate in the first direction are moved relative to each other in the first direction. Thus, in the component having the hat-shaped section, the center portion serves as a top plate, the both side portions serve as flanges, respectively, and portions stretched between the center portion and the both side portions serve as vertical walls, respectively.

Then, the manufacturing device includes the die, the pad, the punch, the holder, and a block. In the die, an opening is formed, the opening being open on a first side in the first direction. The pad is provided inside the opening so that the pad is able to move relative to the die to a second side in the first direction against energizing force towards the first side in the first direction. The punch is arranged to face the pad in the first direction so as to sandwich the center portion. The holder is provided around the punch, and the holder faces the die in the first direction so as to sandwich the both side portions, and is able to move to the first side in the first direction against energizing force towards the second side in the first direction. The block is provided on a part of the holder on the second side in the first direction, and is able to move in a second direction orthogonal to the first direction. The block is moved from a position on the holder, the position not facing the pad in the first direction, to a position on the holder, the position facing the pad in the first direction, so that the block is inserted between the holder and the pad, and a positional relationship between the holder and the pad in a mold closed state is thus maintained even during mold opening.

With this configuration, as the pad and the punch that sandwich the center portion of the metal plate in the first direction, and the die and the holder that sandwich the both side portions of the metal plate in the first direction are moved relative to each other in the first direction. Then, the punch enters the opening of the die while the pad being pushed into the opening to the second side in the first direction. Thus, the component having the hat-shaped section is formed in which the center portion serves as the top plate, the both side portions serve as the flanges, respectively, and the portions stretched between the center portion and the both side portions serve as the vertical walls, respectively.

Further, the block provided on the holder so as to be able to move in the second direction is moved from the position on the holder, the position not facing the pad in the first direction, to the position on the holder, the position facing the pad in the first direction, so that the block is inserted between the holder and the pad. With this simple configuration, a positional relationship between the pad and the holder in a mold closed state is thus maintained even during mold opening. Therefore, it is possible to inhibit compression of the component having the hat-shaped section by pressurizing force from the pad and the holder.

Therefore, the disclosure makes it possible to inhibit deformation of the component having the hat-shaped section at the time of mold release with the simple configuration.

Further, the manufacturing device may include a driving unit that is provided on a part of the holder on the second side in the first direction and moves the block in the second direction.

If the driving device that moves the block in the second direction is provided outside the holder, adjustment of positions of the driving device and the block in the first direction will be complex. Meanwhile, because both the block and the driving device are provided on the holder, it is possible to easily move the block on the holder in the second direction without a need of positioning of the driving device and the block in the first direction.

Further, the disclosure is also applied to a manufacturing method for a component having a hat-shaped section. The manufacturing method is used to manufacture the component having the hat-shaped section from a metal plate.

In the manufacturing method, a manufacturing device is prepared. The manufacturing device includes a die, a pad, a punch, a holder and a block. In the die, an opening is formed, the opening being open on a first side in a first direction. The pad is provided inside the opening so that the pad is able to move relative to the die to a second side in the first direction against energizing force towards the first side in the first direction. The punch is arranged to face the pad in the first direction. The holder is provided around the punch so that the holder faces the die in the first direction and is able to move to the first side in the first direction against energizing force towards the second side in the first direction. The block is provided on a part of the holder on the second side in the first direction, and is able to move in a second direction orthogonal to the first direction.

Then, the manufacturing method includes a step of forming the component having the hat-shaped section as the pad and the punch that sandwich a center portion of the metal plate in the first direction, and the die and the holder that sandwich both side portions of the metal plate in the first direction are moved relative to each other in the first direction due to mold closing so that the center portion serves as a top plate, the both side portions serve as flanges, respectively, and portions stretched between the center portion and the both side portions serve as vertical walls, respectively. The manufacturing method also includes a step of inserting the block between the holder and the pad as the block is moved from a position on the holder, the position not facing the pad in the first direction, to a position on the holder, the position facing the pad in the first direction, after the mold closing and also before mold opening such that a positional relationship between the pad and the holder in a mold closed state is maintained even during the mold opening. The manufacturing method further includes a step of moving the block from the position on the holder, the position facing the pad in the first direction, to the position on the holder, the position not facing the pad in the first direction, after the mold opening and also before mold closing.

With this configuration, it is possible to obtain effects similar to those obtained by the manufacturing device described above.

As described so far, with the manufacturing device and the manufacturing method for the component having the hat-shaped section according to the disclosure, it is possible to inhibit deformation of the component having the hat-shaped section at the time of mold release with the simple configuration.

BRIEF DESCRIPTION OF THE DRAWINGS

Features, advantages, and technical and industrial significance of exemplary embodiments will be described below with reference to the accompanying drawings, in which like signs denote like elements, and wherein.

DETAILED DESCRIPTION OF EMBODIMENTS

Figure 1:
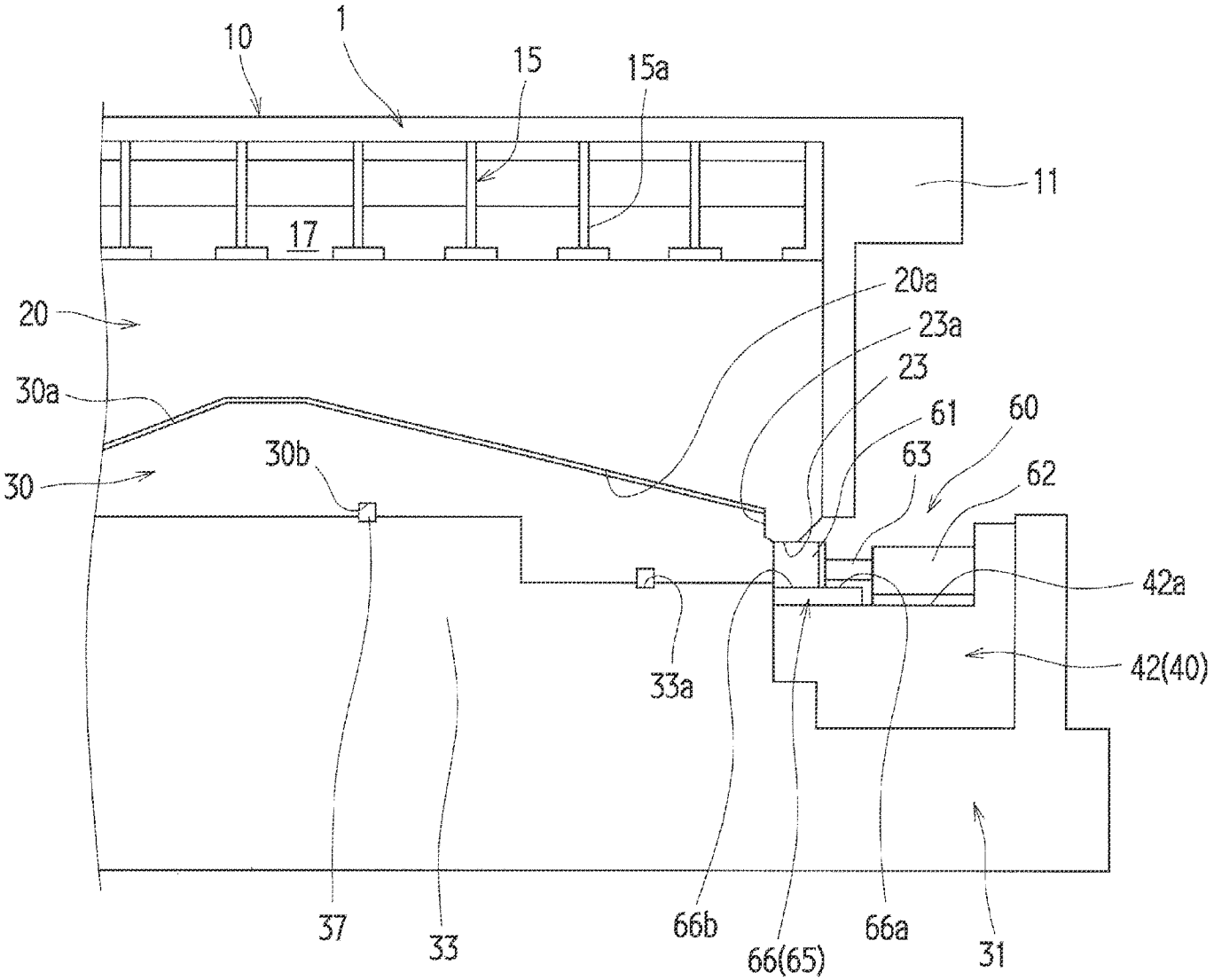
FIG. 1 is a schematic vertical sectional view of a main part of a manufacturing device according to an embodiment of the disclosure.

Hereinafter, an embodiment of the disclosure is described with reference to the drawings. In the description below, for convenience, a right-left direction in FIG. 1 to FIG. 3, FIG. 6, FIG. 8, FIG. 10, FIG. 12, FIG. 14, and FIG. 16 is referred to as a longitudinal direction, and a right-left direction in FIG. 5, FIG. 7, FIG. 9, FIG. 11, FIG. 13, and FIG. 15 is referred to as a direction orthogonal to the longitudinal direction. Also, for a better visibility, only a die piece 13, a pad 20, a punch 30, a holder 40, a metal plate 70, and a component having a hat-shaped section 80 are hatched in lateral sectional views.

Overall Configuration of Manufacturing Device

Figure 5:
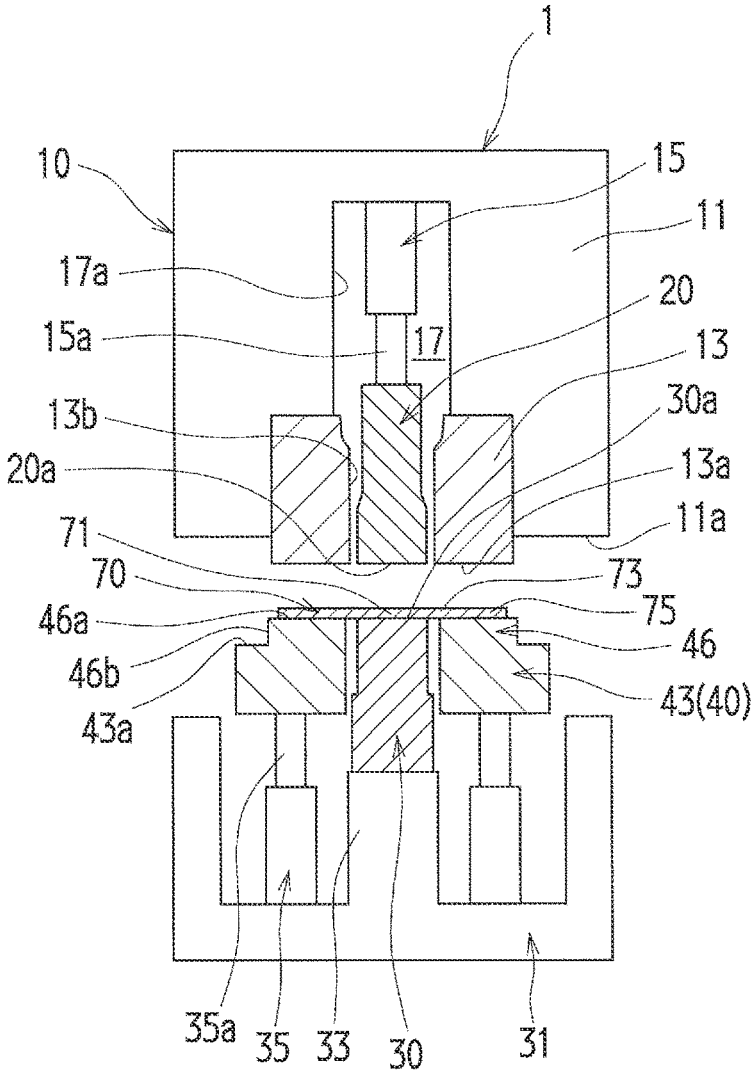
FIG. 5 is a schematic lateral sectional view of a manufacturing procedure 1 for the component having the hat-shaped section.
Figure 6:
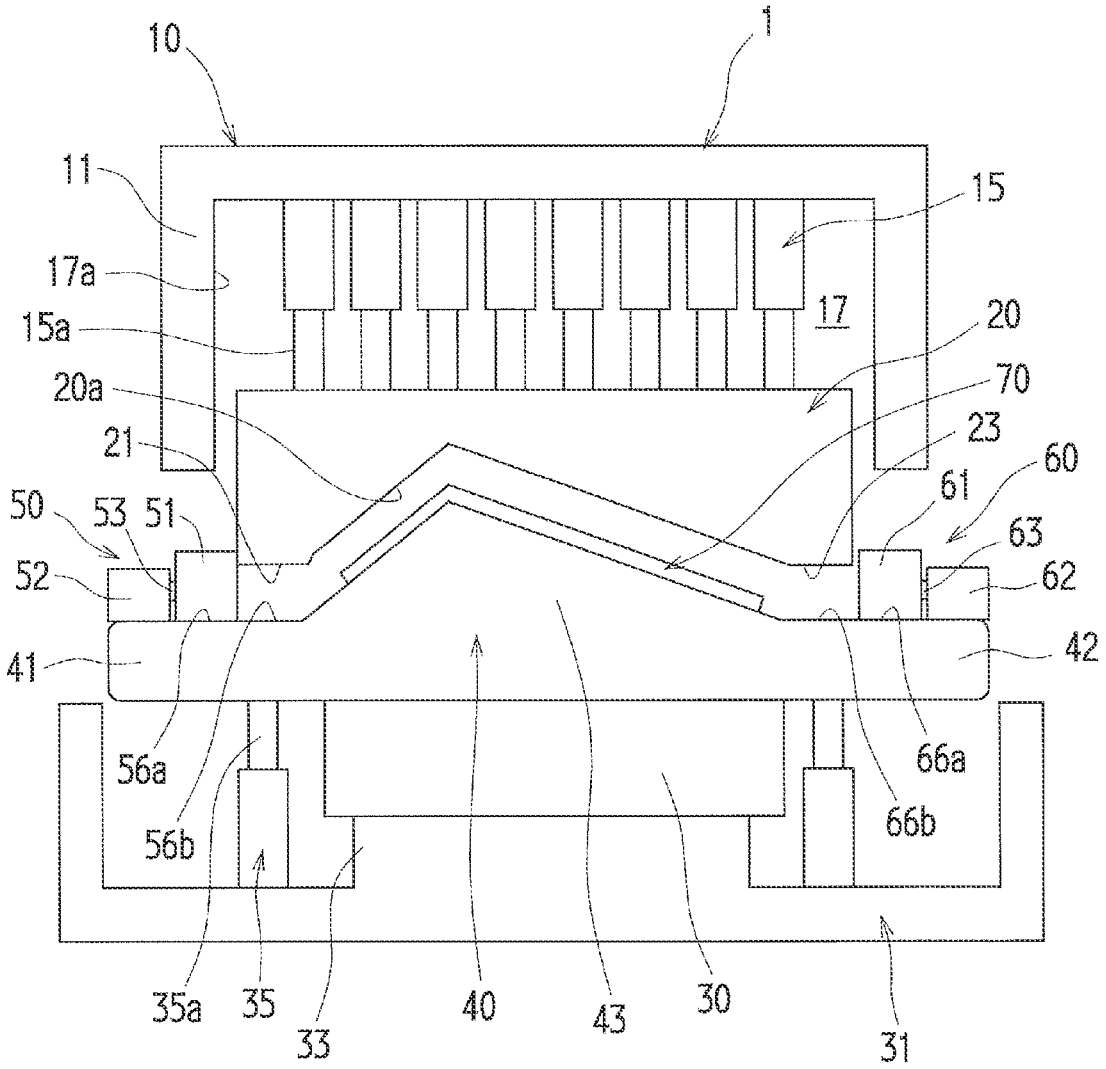
FIG. 6 is a schematic vertical sectional view of the manufacturing procedure 1 for the component having the hat-shaped section.

FIG. 1 is a schematic vertical sectional view of a main part of a manufacturing device 1 according to the embodiment. Further, FIG. 5 and FIG. 6 are a lateral sectional view and a vertical sectional view, respectively, that schematically describe a manufacturing procedure 1 according to the embodiment. As shown in FIG. 1 and FIG. 6, the manufacturing device 1 includes a die 10, the pad 20, the punch 30, the holder 40, and first and second locking mechanisms 50, 60. As shown in FIG. 5 and FIG. 6, the manufacturing device 1 is used to manufacture the component having the hat-shaped section 80 shown in FIG. 4 as pressing (drawing) is performed to the metal plate 70 that is placed on top of the punch 30 and the holder 40 and curved into an almost inverse V-shape along the longitudinal direction.

Component Having a Hat-Shaped Section

Figure 4:
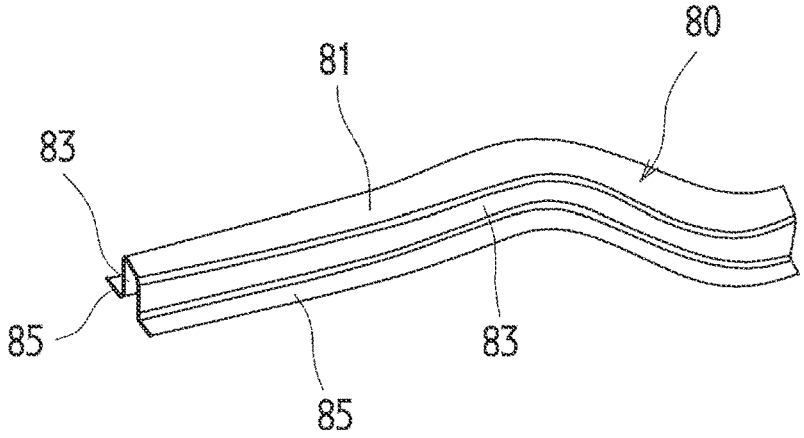
FIG. 4 is a schematic perspective view of a component having a hat-shaped section.

As shown in FIG. 4, the component having the hat-shaped section 80 includes a top plate 81, a pair of vertical walls 83, and a pair of flanges 85. The top plate 81 is curved into an almost inverse V-shape along the longitudinal direction. The vertical walls 83 hang from both end portions of the top plate 81 in the direction orthogonal to the longitudinal direction, respectively. The flanges 85 are curved into an almost inverse V-shape in the longitudinal direction and extend outwardly in the direction orthogonal to the longitudinal direction from lower end portions of the vertical walls 83, respectively. Thus, the hat-shaped section opens downwardly. The flanges 85 of the component having the hat-shaped section 80 are joined to flanges of another component having the hat-shaped section (not shown), respectively, by spot welding or the like. Another component having the hat-shaped section is open upwardly that is opposite to a direction in which the component having the hat-shaped section 80 is open. Thus, a long member having a closed section is formed, and is used as a vehicle skeleton member such as a front-side member.

Die

The die 10 has an almost rectangular parallelepiped shape as a whole and is fixed to a slide of a press machine (not shown). As shown in FIG. 5 and FIG. 6, an opening 17 is formed in the die 10. The opening 17 is open downwardly (on a first side in a first direction). In other words, the die 10 is formed into an almost box shape that is open downwardly. As shown in FIG. 1 and FIG. 5, the die 10 includes a die body portion 11, the die piece 13, and a plurality of nitrogen gas cylinders 15.

Although not shown in FIG. 1 and FIG. 6, a lower end surface 11*a* of the die body portion 11 is curved into an almost inverse V-shape along the longitudinal direction. The die piece 13 is attached to a lower end portion of the die body portion 11, and an inner side surface 13*b* of the die piece 13 forms a part (a lower end portion) of a wall surface 17*a* of the opening 17. As shown in FIG. 5, a lower end surface 13*a* of the die piece 13 projects downwardly so as to be lower than the lower end surface 11*a* of the die body portion 11, is curved into an almost inverse V-shape along the longitudinal direction, and configures a molding surface that pressurizes both side portions 75 of the metal plate 70 at the time of pressing. As shown in FIG. 1 and FIG. 6, the nitrogen gas cylinders 15 are attached to an upper surface of the opening 17, and rods 15*a* always project downwardly due to pressure of nitrogen gas.

Pad

The pad 20 is formed into an almost rectangular parallelepiped shape, and, as shown in FIG. 1, FIG. 5, and FIG. 6, the pad 20 is provided inside the opening 17 of the die 10 and an upper end of the pad 20 is attached to lower ends of the rods 15*a* of the nitrogen gas cylinders 15. Thus, the pad 20 is always energized downwardly by the nitrogen gas cylinders 15. However, when upward pressing force acts on the pad 20, the pad 20 is able to move upwardly (to a second side in the first direction) relative to the die 10 against the energizing force from the nitrogen gas cylinders 15.

A lower surface of the pad 20 includes a central lower surface 20*a* that configures a molding surface that pressurizes a center portion 71 of the metal plate 70 at the time of pressing. As shown in FIG. 6, the central lower surface 20*a* is curved into an almost inverse V-shape along the longitudinal direction. Meanwhile, a first lower surface 21 on a first side in the longitudinal direction (the left side in FIG. 6) and a second lower surface 23 on a second side in the longitudinal direction (the right side in FIG. 6) are formed so as to be almost horizontal. As shown in FIG. 5, the pad 20 is arranged inside the opening 17 so that the central lower surface 20*a* is flush with the lower end surface 13*a* of the die piece 13 in a state where the pad 20 is lowered most because the pad 20 is energized downwardly by the nitrogen gas cylinders 15 (the rods 15*a* are most extended). As shown in FIG. 1, the central lower surface 20*a* and the second lower surface 23 are connected with each other through a level difference 23*a* (this is the same for the first lower surface 21). However, in FIG. 6, the level difference 23*a* is not shown.

Punch

As shown in FIG. 1, FIG. 5, and FIG. 6, the punch 30 is attached to a lower mold 31 that is fixed to a bolster of the press machine. The lower mold 31 is formed into an almost box shape that is open upwardly, and a punch holder 33 extending upwardly is provided in a center portion of the lower mold 31. Because the punch 30 is attached to an upper end portion of the punch holder 33, the punch 30 is arranged so that an upper surface 30*a* of the punch 30 faces the central lower surface 20*a* of the pad 20 in the upper-lower direction (the first direction). The upper surface 30*a* of the punch 30 is curved into an almost inverse V-shape along the longitudinal direction similarly to the central lower surface 20*a* of the pad 20, and configures a molding surface that pressurizes the center portion 71 of the metal plate 70 at the time of pressing.

As described above, while the die 10 is fixed to the slide of the press machine, the lower mold 31 is fixed to the bolster of the press machine. Therefore, it is easy to align the die 10 and the lower mold 31. Therefore, in order to allow the upper surface 30*a* of the punch 30 and the central lower surface 20*a* of the pad 20 to face each other accurately in the upper-lower direction, it is necessary to accurately position the punch 30 with respect to the lower mold 31. In this regard, in the embodiment, as shown in FIG. 1, the punch 30 is positioned accurately with respect to the lower mold 31 as a positioning block 37 is fitted into a recessed portion 30*b* formed in a lower end portion of the punch 30, and into a recessed portion 33*a* formed in an upper end portion of the punch holder 33 in a form of spigot joint.

Holder

Figure 2:
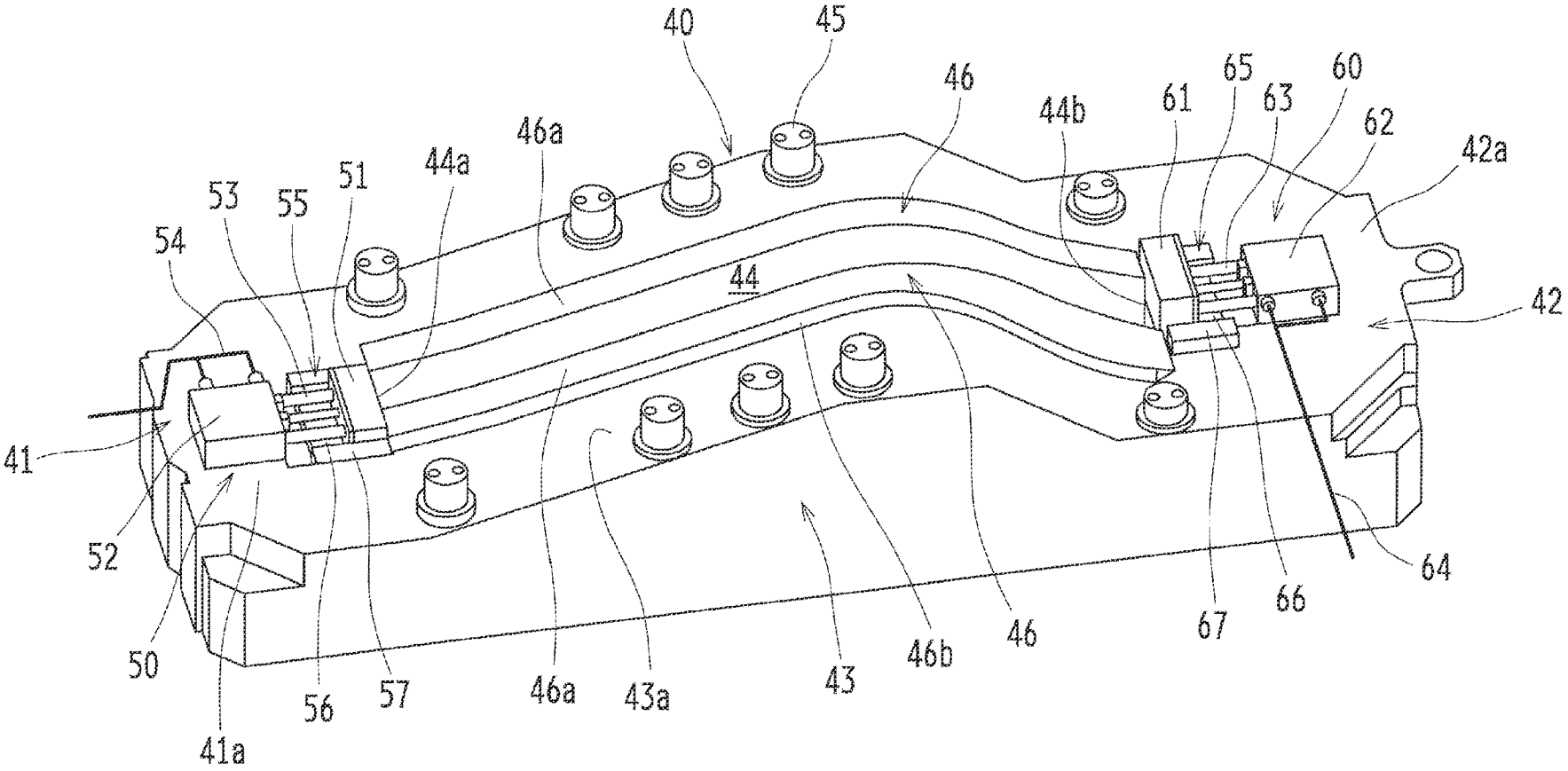
FIG. 2 is a schematic perspective view of a holder.
Figure 3:
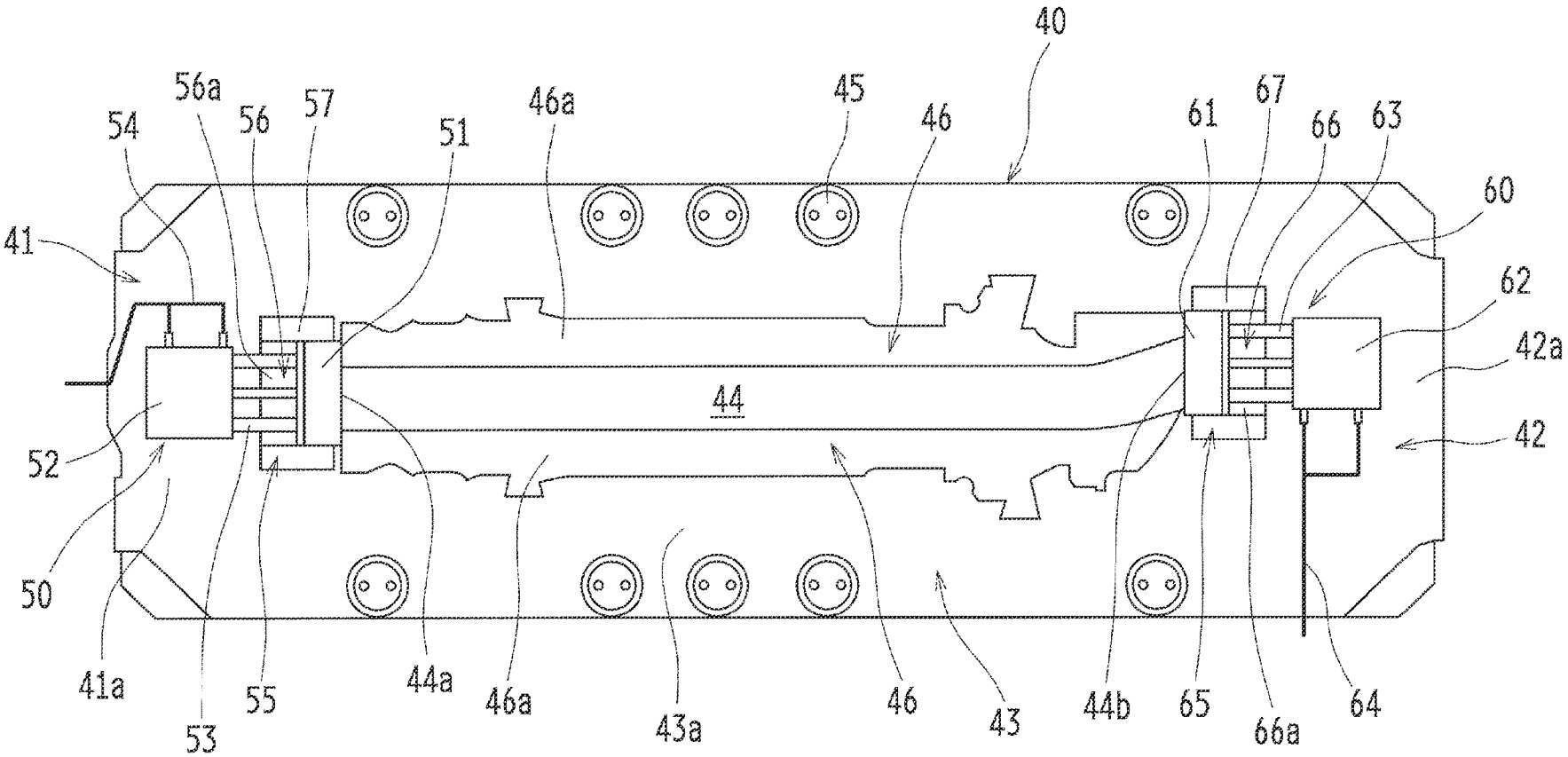
FIG. 3 is a schematic plan view of the holder.

FIG. 2 and FIG. 3 are a perspective view and a plan view schematically showing the holder 40, respectively. As shown in FIG. 2 and FIG. 3, the holder 40 is formed into an almost rectangular ring shape. To be more specific, the holder 40 includes a first portion 41, a second portion 42, and a third portion 43. The first portion 41 is positioned in a portion of the holder 40 on the first side in the longitudinal direction (the left side in FIG. 2 and FIG. 3), and the second portion 42 is positioned in a portion of the holder 40 on the second side in the longitudinal direction (the right side in FIG. 2 and FIG. 3). The third portion 43 is positioned between the first portion 41 and the second portion 42. An upper surface 41*a* of the first portion 41 and an upper surface 42*a* of the second portion 42 are formed so as to be almost horizontal. Meanwhile, an upper surface 43*a* of the third portion 43 is curved into an almost inverse V-shape along the longitudinal direction. In a center portion of the third portion 43 in the direction orthogonal to the longitudinal direction, an opening 44 that penetrates the third portion 43 in the upper-lower direction is formed throughout the entire length of the third portion 43 in the longitudinal direction. Thus, the holder 40 forms the almost rectangular ring shape.

In the both end portions of the third portion 43 in the direction orthogonal to the longitudinal direction, a plurality of distance blocks 45 extending upwardly from the upper surface 43*a* is provided at intervals in the longitudinal direction. As described above, the upper surface 43*a* of the third portion 43 has recesses and projections as the distance blocks 45 and so on are provided. However, side edge portions 46 of the opening 44 in the third portion 43 are a step higher than the upper surface 43*a* through level difference portions 46*b*, respectively, and upper surfaces 46*a* of the side edge portions 46 configure molding surfaces that pressurize the both side portions 75 of the metal plate 70, respectively, at the time of pressing. Therefore, the upper surfaces 46*a* are formed so as to become smooth surfaces curved into an almost inverse V-shape along the longitudinal direction.

As the holder 40 formed as described above is arranged on the lower mold 31 so that the punch 30 is inserted into the opening 44, the holder 40 is positioned around the punch 30. As shown in FIG. 5 and FIG. 6, a plurality of nitrogen gas cylinders 35 is provided around the punch holder 33 of the lower mold 31, and rods 35*a* always project upwardly due to pressure of nitrogen gas. A lower end of the holder 40 is attached to upper ends of the rods 35*a* of the nitrogen gas cylinders 35. Thus, the holder 40 is always energized upwardly by the nitrogen gas cylinders 35. However, when downward pressing force acts on the holder 40, the holder 40 is able to move downwardly against the energizing force of the nitrogen gas cylinders 35. The holder 40 is arranged on the lower mold 31 so that the upper surfaces 46*a* of the side edge portions 46 are flush with the upper surface 30*a* of the punch 30 in a state where the holder 40 is elevated most as the holder 40 is energized upwardly by the nitrogen gas cylinders 35 (the rods 35*a* are extended most).

As described above, the lower mold 31 in which the holder 40 is arranged around the punch 30 is fixed to the bolster of the press machine, and the die 10 is fixed to the slide of the press machine. Then, the die 10 and the holder 40 face each other in the upper-lower direction. To be more specific, the lower end surface 13*a* of the die piece 13 and the upper surfaces 46*a* of the side edge portions 46 of the holder 40 face each other in the upper-lower direction. At the same time, the lower end surface 11*a* of the die body portion 11 and the upper surface 43*a* of the holder 40 (except the upper surfaces 46*a* of the side edge portions 46) face each other in the upper-lower direction.

Then, as the slide of the press machine is driven to lower the die 10, the lower end surface 13*a* of the die piece 13, the lower end surface 13*a* projecting downwardly so as to be lower than the lower end surface 11*a* of the die body portion 11, moves closer to the upper surfaces 46*a* of the side edge portions 46 of the holder 40. However, because the distance blocks 45 provided on the upper surface 43*a* of the holder 40 come into contact with the lower end surface 11*a* of the die body portion 11, the lower end surface 13*a* of the die piece 13 does not come into contact with the upper surfaces 46*a* of the side edge portions 46, and a gap between both the lower end surface 13*a* and the upper surfaces 46*a* is maintained constant. In FIG. 5 to FIG. 16, for better visibility, the distance blocks 45 are not shown.

Further, first and second locking mechanisms 50, 60 are provided on top of the holder 40. However, the first and second locking mechanisms 50, 60 are described later.

Figure 7:
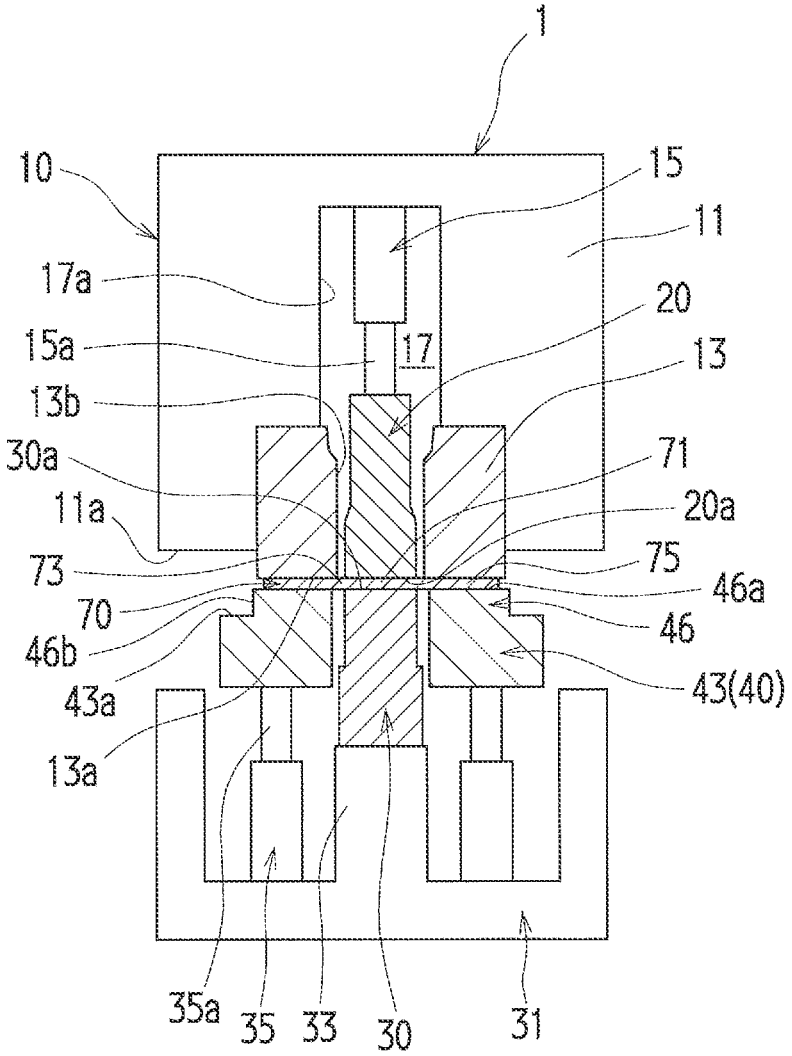
FIG. 7 is a schematic lateral sectional view of a manufacturing procedure 2 for the component having the hat-shaped section.
Figure 8:
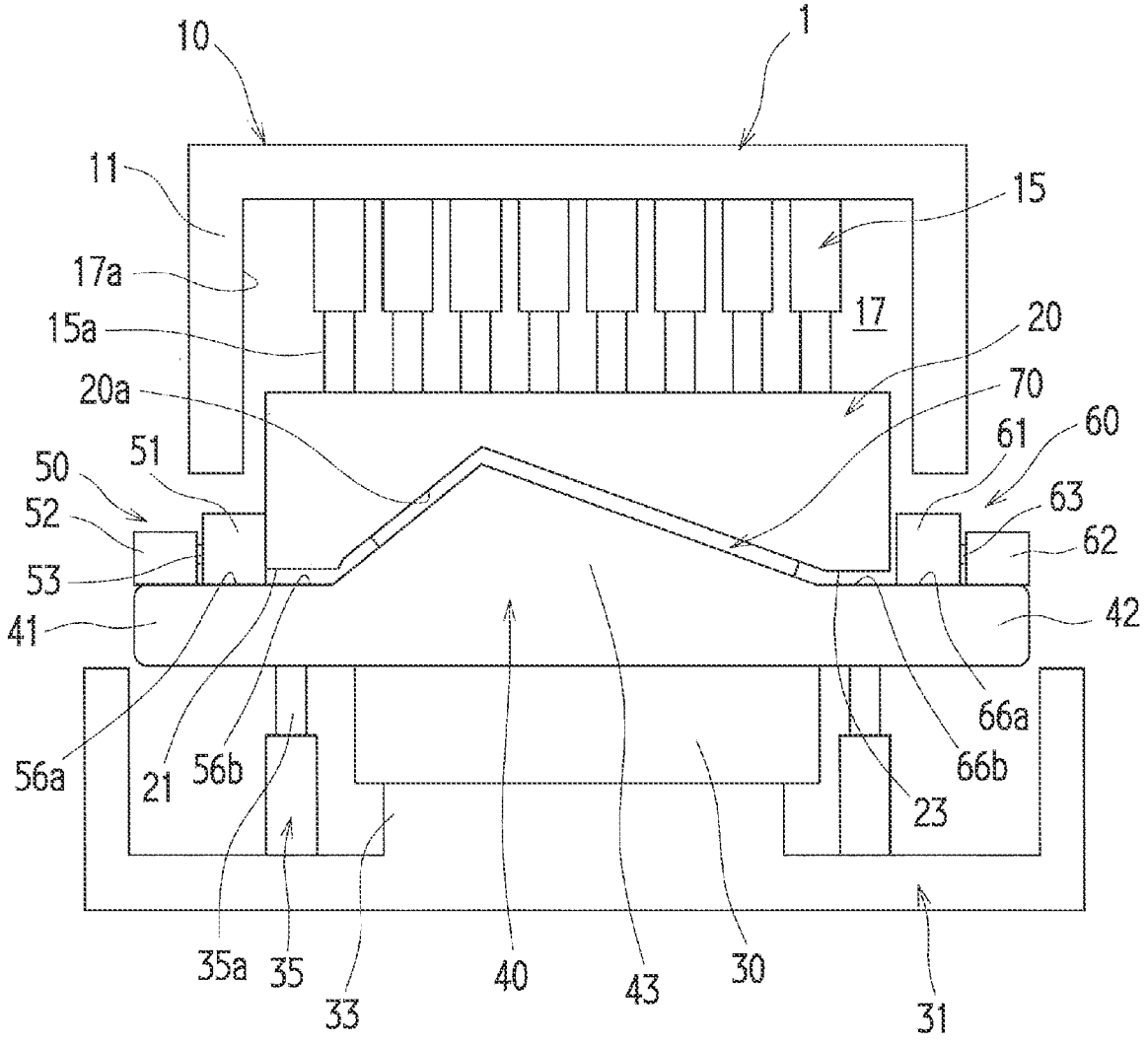
FIG. 8 is a schematic vertical sectional view of the manufacturing procedure 2 for the component having the hat-shaped section.
Figure 9:
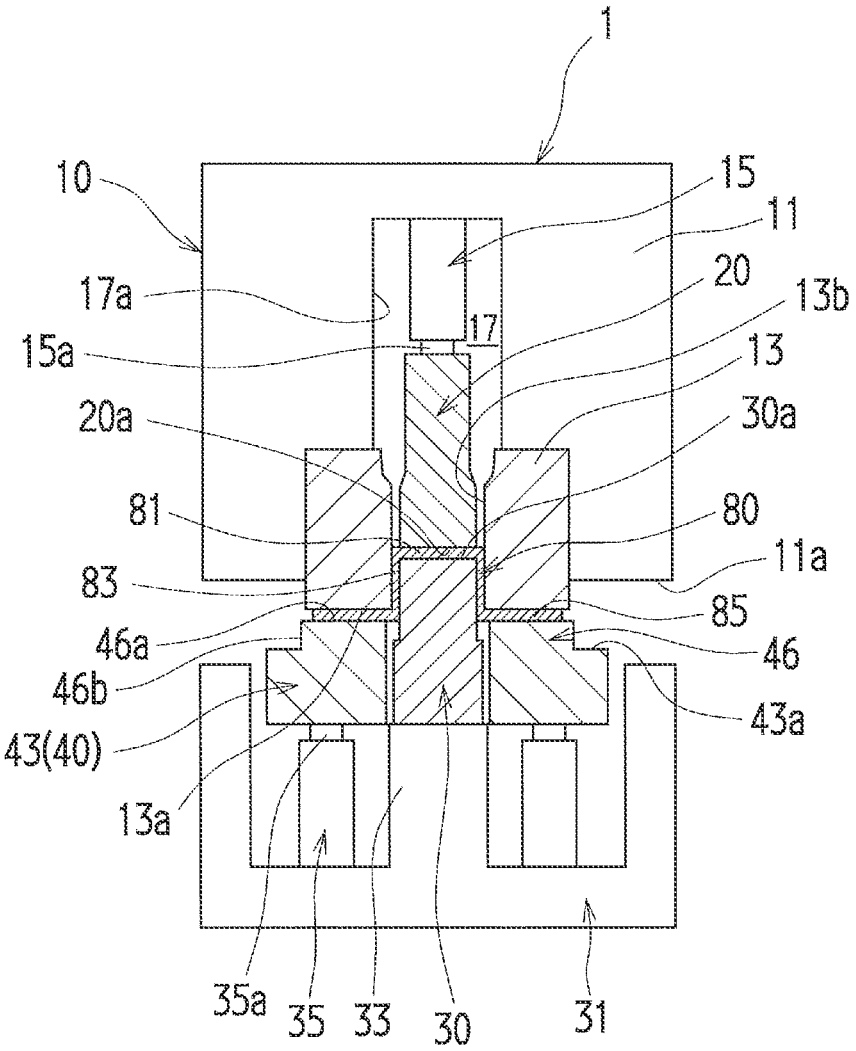
FIG. 9 is a schematic lateral sectional view of a manufacturing procedure 3 for the component having the hat-shaped section.
Figure 10:
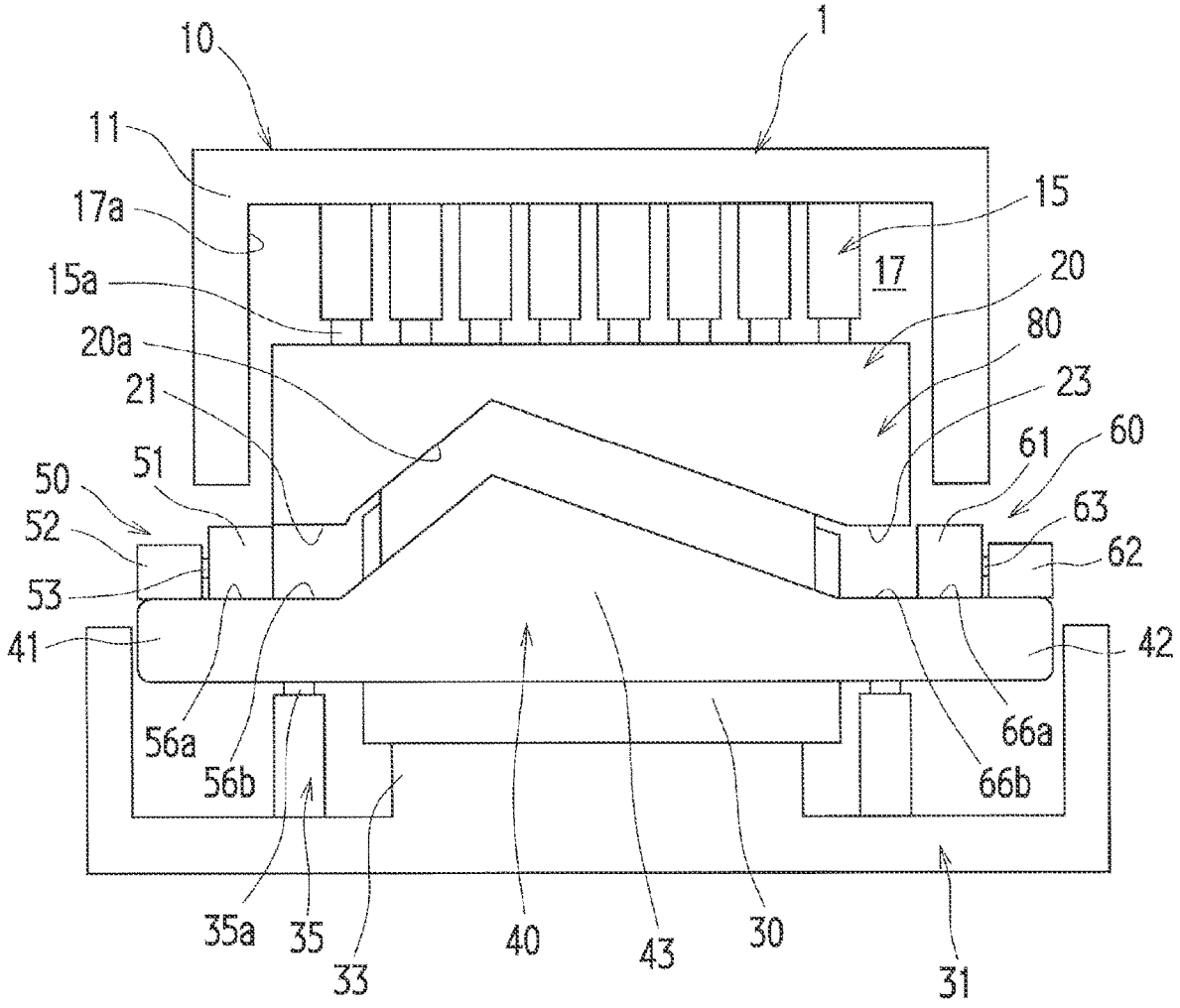
FIG. 10 is a schematic vertical sectional view of the manufacturing procedure 3 for the component having the hat-shaped section.

FIG. 7 and FIG. 8 are a lateral sectional view and a vertical sectional view, respectively, schematically showing a manufacturing procedure 2 according to the embodiment. Further, FIG. 9 and FIG. 10 are a lateral sectional view and a vertical sectional view, respectively, schematically showing a manufacturing procedure 3 according to the embodiment.

When the component having the hat-shaped section 80 is manufactured with use of the manufacturing device 1 configured as described above, first of all, as shown in FIG. 5 and FIG. 6, the metal plate 70 curved into the almost inverse V-shape along the longitudinal direction is placed on the punch 30 and the holder 40. To be more specific, as shown in FIG. 5, the center portion 71 of the metal plate 70 in the direction orthogonal to the longitudinal direction is placed on the upper surface 30*a* of the punch 30, and, at the same time, the both side portions 75 of the metal plate 70 in the direction orthogonal to the longitudinal direction are placed on the upper surfaces 46*a* of the side edge portions 46 of the holder 40, respectively. In this state, downward pressing force is not acting on the holder 40, and the rods 35*a* are extended most. Therefore, the upper surface 30*a* of the punch 30 and the upper surfaces 46*a* of the side edge portions 46 are flush with each other.

Next, when the slide of the press machine is driven to lower the die 10, as shown in FIG. 7 and FIG. 8, the center portion 71 of the metal plate 70 is sandwiched between the central lower surface 20*a* of the pad 20 and the upper surface 30*a* of the punch 30 in the upper-lower direction. At the same time, the both side portions 75 of the metal plate 70 are sandwiched between the lower end surface 13*a* of the die piece 13 and the upper surfaces 46*a* of the side edge portions 46 of the holder 40 in the upper-lower direction.

From this state, the die 10 is lowered further, and the pad 20 and the punch 30 that sandwich the center portion 71 of the metal plate 70 in the upper-lower direction, and the die 10 and the holder 40 that sandwich the both side portions 75 of the metal plate 70 in the upper-lower direction are moved relative to each other in the upper-lower direction. Specifically, when the die 10 is lowered further, as shown in FIG. 9 and FIG. 10, the holder 40 that is pushed by the die piece 13 downwardly moves downwardly against the energizing force of the nitrogen gas cylinders 35, and the pad 20 that is pushed relatively upwardly by the punch 30 is moved upwardly relative to the die 10 against the energizing force of the nitrogen gas cylinders 15. Thus, the punch 30 enters the opening 17 of the die 10 while the punch 30 is pressing the pad 20 into the opening 17 relatively upwardly. As a result, the component having the hat-shaped section 80 is formed as shown in FIG. 9. In the component having the hat-shaped section 80, the center portion 71 serves as the top plate 81, the both side portions 75 serve as the flanges 85, portions 73 stretched between both the center portion 71 and the both side portions 75 serve as the vertical walls 83, respectively.

Locking Mechanisms

Next, the first and second locking mechanisms 50, 60 are described. However, prior to that, a manufacturing device for a component having a hat-shaped section 180 according to a related art is described in order to facilitate understanding of the disclosure.

Figure 17:
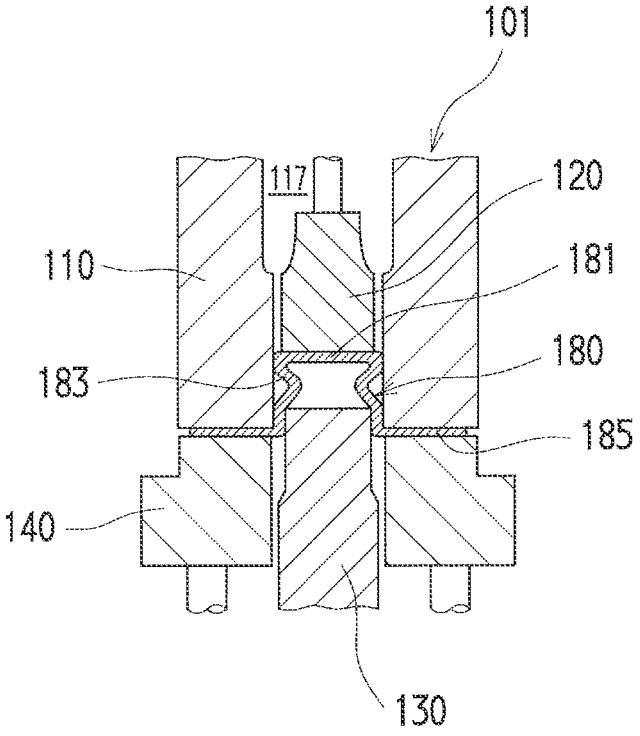
FIG. 17 RELATED ART
FIG. 17 is a schematic lateral sectional view of a manufacturing device according to a related art.

FIG. 17 is a schematic lateral sectional view of a manufacturing device 101 according to the related art. As shown in FIG. 17, the manufacturing device 101 according to the related art is similar to the manufacturing device 1 according to the embodiment in that the component having the hat-shaped section 180 is manufactured as a pad 120 and a punch 130 that sandwich a center portion of a metal plate in an upper-lower direction, and a die 110 and a holder 140 that sandwich both side portions of the metal plate in the upper-lower direction are moved relative to each other in the upper-lower direction.

There is a problem in the manufacturing device 101 according to the related art. Specifically, at the time of mold release (when a mold is opened), when the die 110 is moved upwardly, the punch 130 comes out of an opening 117 of the die 110, and the pad 120 is moved downwardly by energizing force inside the opening 117 of the die 110. Meanwhile, the holder 140 moves relatively upwardly around the punch 130 by energizing force. Then, the punch 130 is moved away from a lower surface of a top plate 181. Also, pressurizing force from the pad 120 due to the energizing force acts on the top plate 181 from above, the top plate 181 losing support from below by the punch 130, and pressurizing force from the holder 140 due to the energizing force acts on flanges 185 from below. Thus, the component having the hat-shaped section 180 is compressed in the upper-lower direction due to pressurization of the pad 120 and the holder 140, and this could result in deformation of the vertical walls 183 in a form of buckling as shown in FIG. 17.

Accordingly, in the manufacturing device 1 according to the embodiment, the locking blocks 51, 61 are inserted between the pad 20 and the holder 40, and the locking blocks 51, 61 receive pressurizing force from the pad 20 and the holder 40 generated by the energizing force from the nitrogen gas cylinders 15, 35, the pressurizing force being supposed to be acting on the component having the hat-shaped section 80 at the time of mold release. Thus, the pressurizing force is not allowed to act on the component having the hat-shaped section 80.

Specifically, the manufacturing device 1 includes the first and second locking mechanisms 50, 60 that have the locking blocks 51, 61, and the air cylinders (driving devices) 52, 62, respectively. The locking blocks 51, 61 are provided on top of the holder 40 so that the locking blocks 51, 61 are able to move in a horizontal direction. The air cylinders 52, 62 are also provided on top of the holder 40 and move the locking blocks 51, 61 in the horizontal direction. Then, the locking blocks 51, 61 are moved from positions on the holder 40, the positions not facing the pad 20 in the upper-lower direction, to positions on the holder 40, the positions facing the pad 20 in the upper-lower direction, respectively, so that the locking blocks 51, 61 are inserted between the holder 40 and the pad 20. Thus, a positional relationship between the holder 40 and the pad 20 in the upper-lower direction in a mold closed state is maintained even during mold opening.

As shown in FIG. 2 and FIG. 3, the first locking mechanism 50 is provided on the upper surface 41*a* of the first portion 41 of the holder. Meanwhile, as shown in FIG. 1 to FIG. 3, the second locking mechanism 60 is provided on the upper surface 42*a* of the second portion 42 of the holder 40. FIG. 1 to FIG. 3 show a state where the locking blocks 51, 61 are at positions on the holder 40, the positions facing the pad 20 in the upper-lower direction (facing positions 56*b*, 66*b*).

As described earlier, the first locking mechanism 50 includes the locking block 51 and the air cylinder 52. The air cylinder 52 is configured so that three rods 53 are advanced and retreated by compressed air supplied (discharged) through a pipe 54. The air cylinder 52 is arranged at a position on the upper surface 41*a* of the first portion 41 of the holder 40, the position corresponding to an end portion 44*a* of the opening 44 on the first side in the longitudinal direction so that the three rods 53 advance to the second side in the longitudinal direction. The locking block 51 is attached to distal end portions of the three rods 53, and is advanced and retreated by the air cylinder 52 in the longitudinal direction.

A guide 55 having an almost rectangular-shaped support portion 56 and guide wall portions 57 is arranged between the air cylinder 52 and the end portion 44*a* of the opening 44 on the first side in the longitudinal direction. The guide wall portions 57 extend upwardly from both end portions of the support portion 56 in the direction orthogonal to the longitudinal direction, respectively. The locking block 51 attached to the distal end portions of the three rods 53 is placed on the support portion 56, and both ends of the locking block 51 in the direction orthogonal to the longitudinal direction are sandwiched between the guide wall portions 57. Thus, the locking block 51 slides straight on the support portion 56 in the longitudinal direction. In FIG. 6, FIG. 8, FIG. 10, FIG. 12, FIG. 14, and FIG. 16, the guide 55 is not shown for better visibility.

When the locking block 51 is positioned at an end portion 56*a* of the support portion 56 on the first side in the longitudinal direction, the locking block 51 does not overlap the first lower surface 21 of the pad 20 in a plan view. Meanwhile, when the locking block 51 is positioned at the end portion 56*b* (see FIG. 6, etc.) of the support portion 56 on the second side in the longitudinal direction, the locking block 51 is positioned immediately below the first lower surface 21 of the pad 20. Therefore, in relation to the claims, the end portion 56*a* of the support portion 56 on the first side in the longitudinal direction corresponds to "a position on the holder, the position not facing the pad in the first direction", and the end portion 56*b* of the support portion 56 on the second side in the longitudinal direction corresponds to "a position on the holder, the position facing the pad in the first direction". Thus, in the description below, the end portion 56*a* of the support portion 56 on the first side in the longitudinal direction is also referred to as "the non-facing position 56*a*", and the end portion 56*b* of the support portion 56 on the second side in the longitudinal direction is also referred to as "the facing position 56*b*".

The second locking mechanism 60 also includes the locking block 61 and the air cylinder 62. The air cylinder 62 is configured so that three rods 63 are advanced and retreated by compressed air supplied (discharged) through a pipe 64. The air cylinder 62 is arranged at a position on the upper surface 42*a* of the second portion 42 of the holder 40, the position corresponding to an end portion 44*b* of the opening 44 on the second side in the longitudinal direction. Thus, the three rods 63 advance to the first side in the longitudinal direction. The locking block 61 is attached to distal end portions of the three rods 63, and is advanced and retreated in the longitudinal direction by the air cylinder 62.

A guide 65 is arranged between the air cylinder 62 and the end portion 44*b* of the opening 44 on the second side in the longitudinal direction. The guide 65 includes an almost rectangular-shaped support portion 66, and guide wall portions 67 that extend upwardly from both end portions of the support portion 66 in the direction orthogonal to the longitudinal direction, respectively. The locking block 61 attached to the distal end portions of the three rods 63 is placed on the support portion 66, and both end portions of the locking block 61 in the direction orthogonal to the longitudinal direction are sandwiched between the guide wall portions 67. Thus, the locking block 61 slides straight on the support portion 66 in the longitudinal direction. In FIG. 6, FIG. 8, FIG. 10, FIG. 12, FIG. 14, and FIG. 16, the guide 65 is not shown for better visibility.

As shown in FIG. 1, when the locking block 61 is positioned at an end portion 66*a* of the support portion 66 on the second side in the longitudinal direction, the locking block 61 does not overlap the second lower surface 23 of the pad 20 in a plan view. Meanwhile, when the locking block 61 is positioned at the end portion 66*b* of the support portion 66 on the first side in the longitudinal direction, the locking block 61 is positioned immediately below the second lower surface 23 of the pad 20. Therefore, in relation to the claims, the end portion 66*a* of the support portion 66 on the second side in the longitudinal direction corresponds to "a position on the holder, the position not facing the pad in the first direction", and the end portion 66*b* of the support portion 66 on the first side in the longitudinal direction corresponds to "a position on the holder, the position facing the pad in the first direction". Therefore, in the description below, the end portion 66*a* of the support portion 66 on the second side in the longitudinal direction is also referred to as "the non-facing position 66*a*", and the end portion 66*b* of the support portion 66 on the first side in the longitudinal direction is also referred to as "the facing position 66*b*".

Advancement and retreat of the locking blocks 51, 61 of the first and second locking mechanisms 50, 60 configured as described above, in other words, drive of the air cylinders 52, 62 is controlled by a control device (not shown) or by an operation by an operator, for example. Specifically, every time the component having the hat-shaped section 80 is formed, the locking blocks 51, 61 are moved from the non-facing positions 56*a*, 66*a* to the facing positions 56*b*, 66*b*, respectively, after mold closing and before mold opening (at a bottom dead point of forming). At the same time, the locking blocks 51, 61 are moved from the facing positions 56*b*, 66*b* to the non-facing positions 56*a*, 66*a*, respectively, after the mold opening and before mold closing (at a top dead point of forming).

Manufacturing Method

Next, a manufacturing method for the component having the hat-shaped section 80 with use of the manufacturing device 1 having the first and second locking mechanisms 50, 60 is described.

Figure 11:
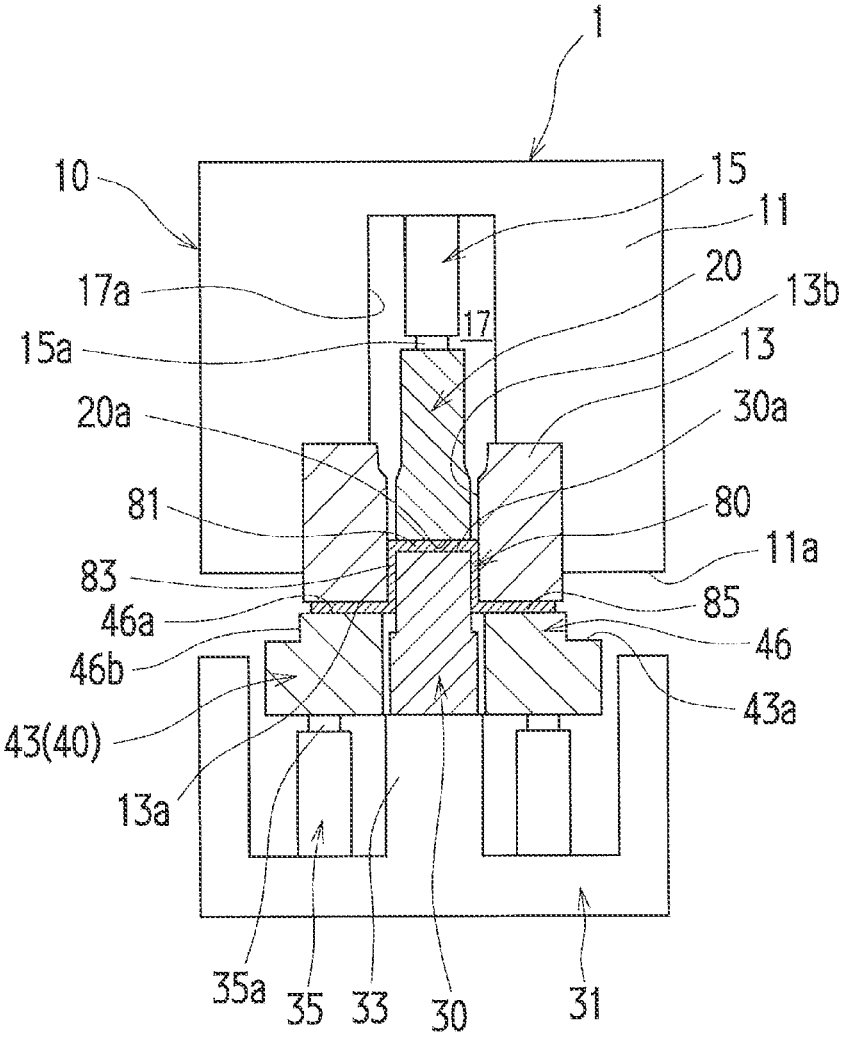
FIG. 11 is a schematic lateral sectional view of a manufacturing procedure 4 for the component having the hat-shaped section.
Figure 12:
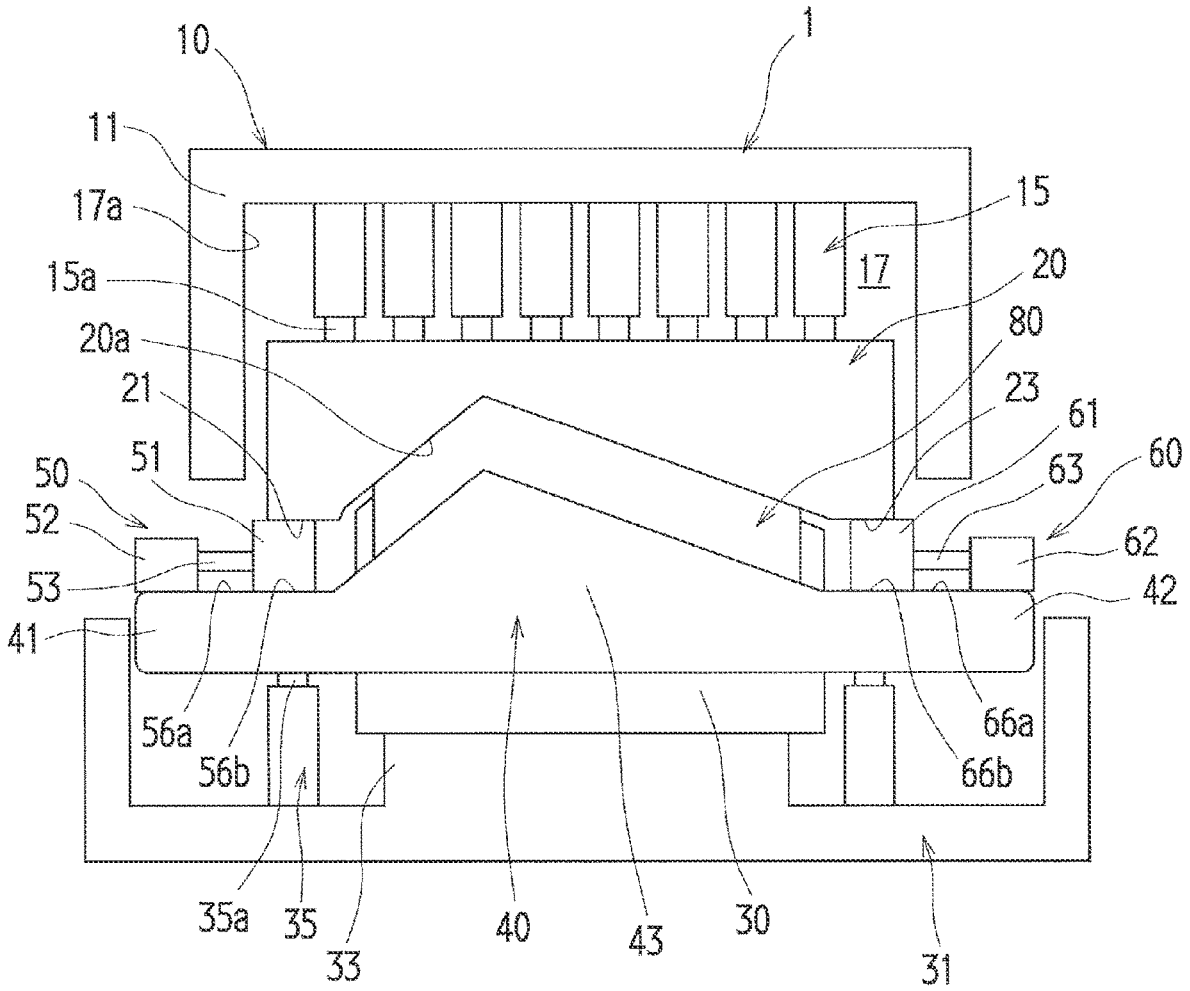
FIG. 12 is a schematic vertical sectional view of the manufacturing procedure 4 for the component having the hat-shaped section.
Figure 13:
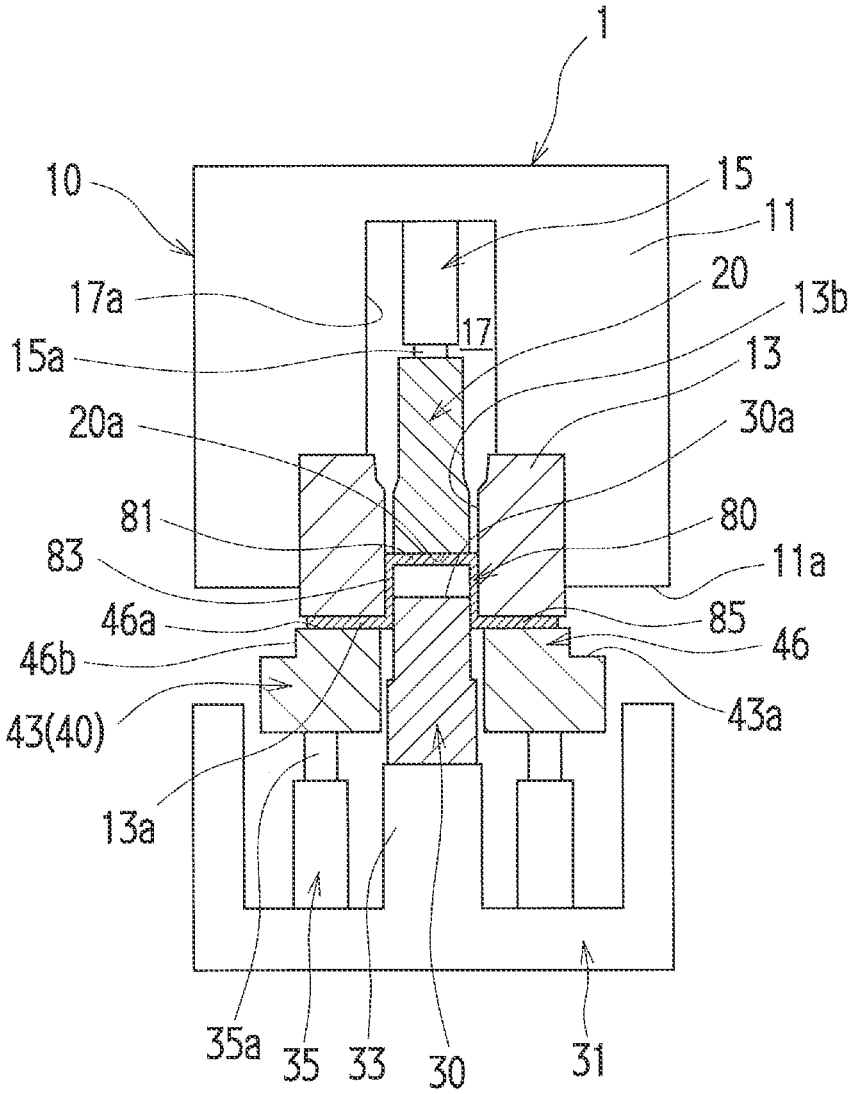
FIG. 13 is a schematic lateral sectional view of a manufacturing procedure 5 for the component having the hat-shaped section.
Figure 14:
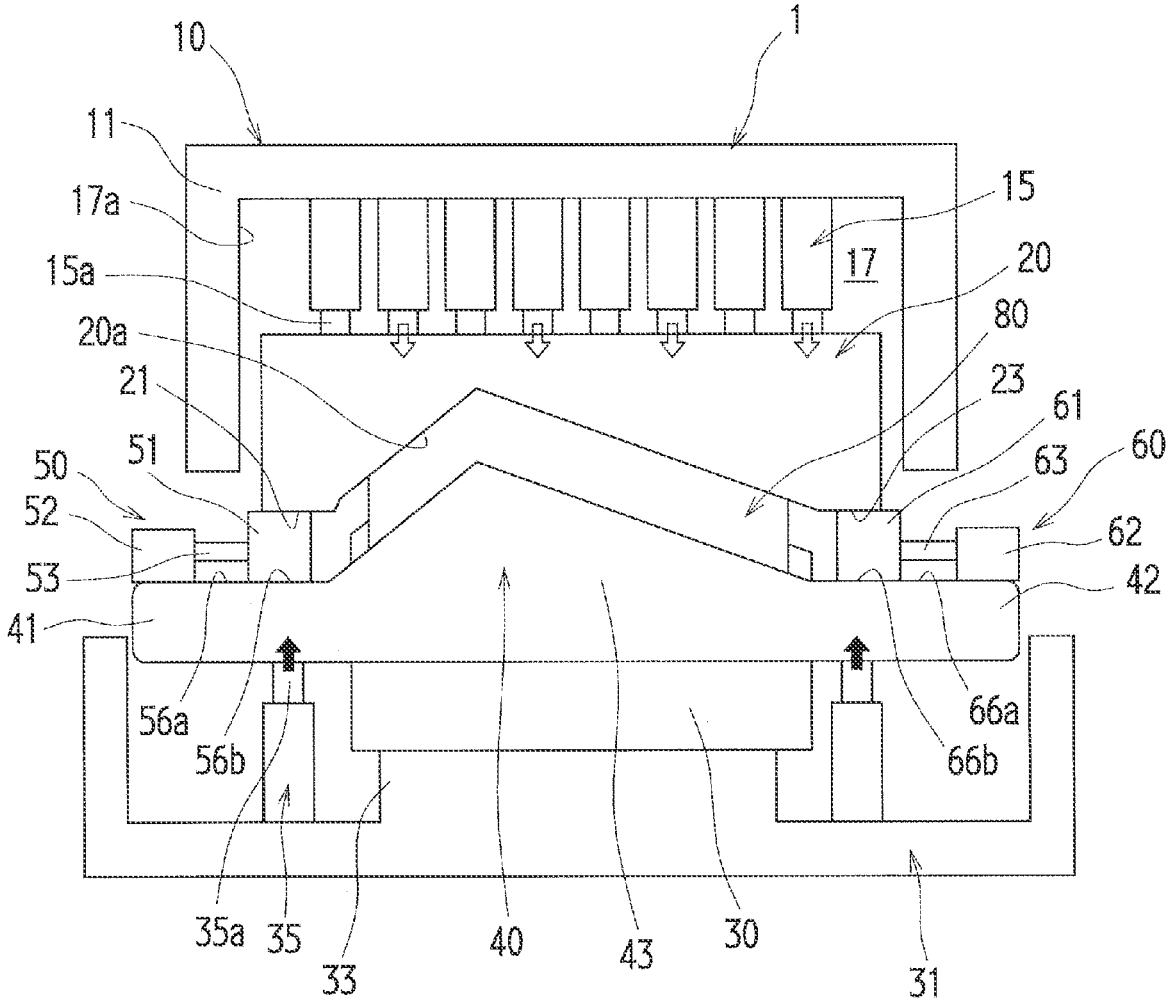
FIG. 14 is a schematic vertical sectional view of the manufacturing procedure 5 for the component having the hat-shaped section.
Figure 15:
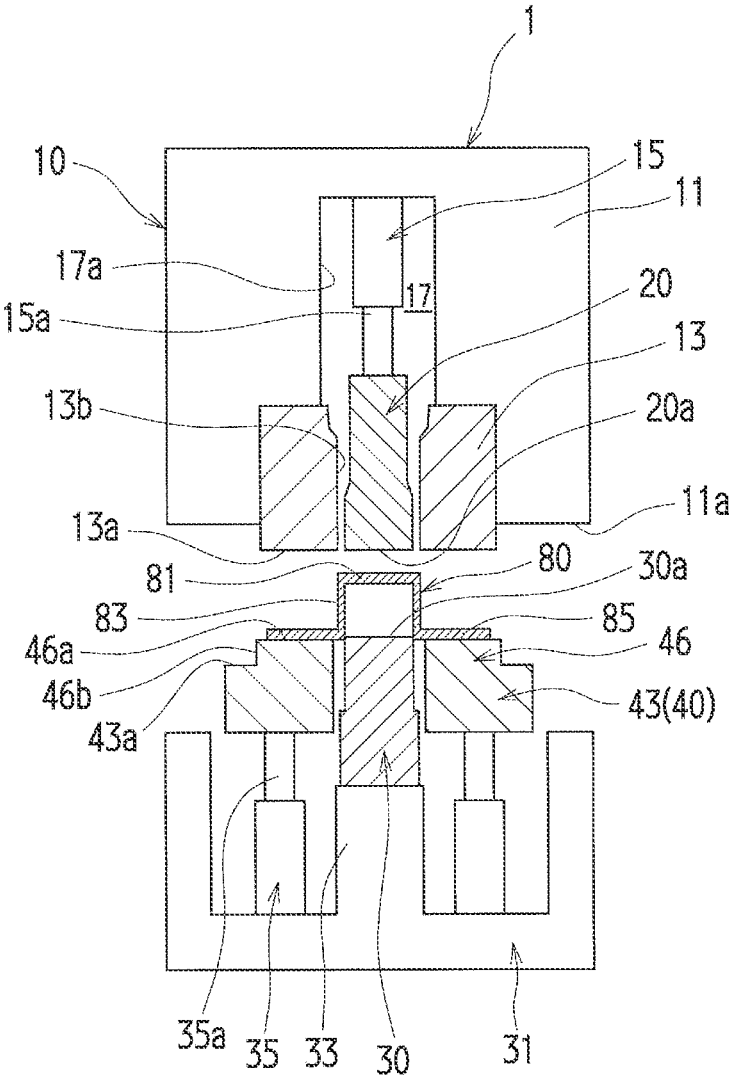
FIG. 15 is a schematic lateral sectional view of a manufacturing procedure 6 for the component having the hat-shaped section.
Figure 16:
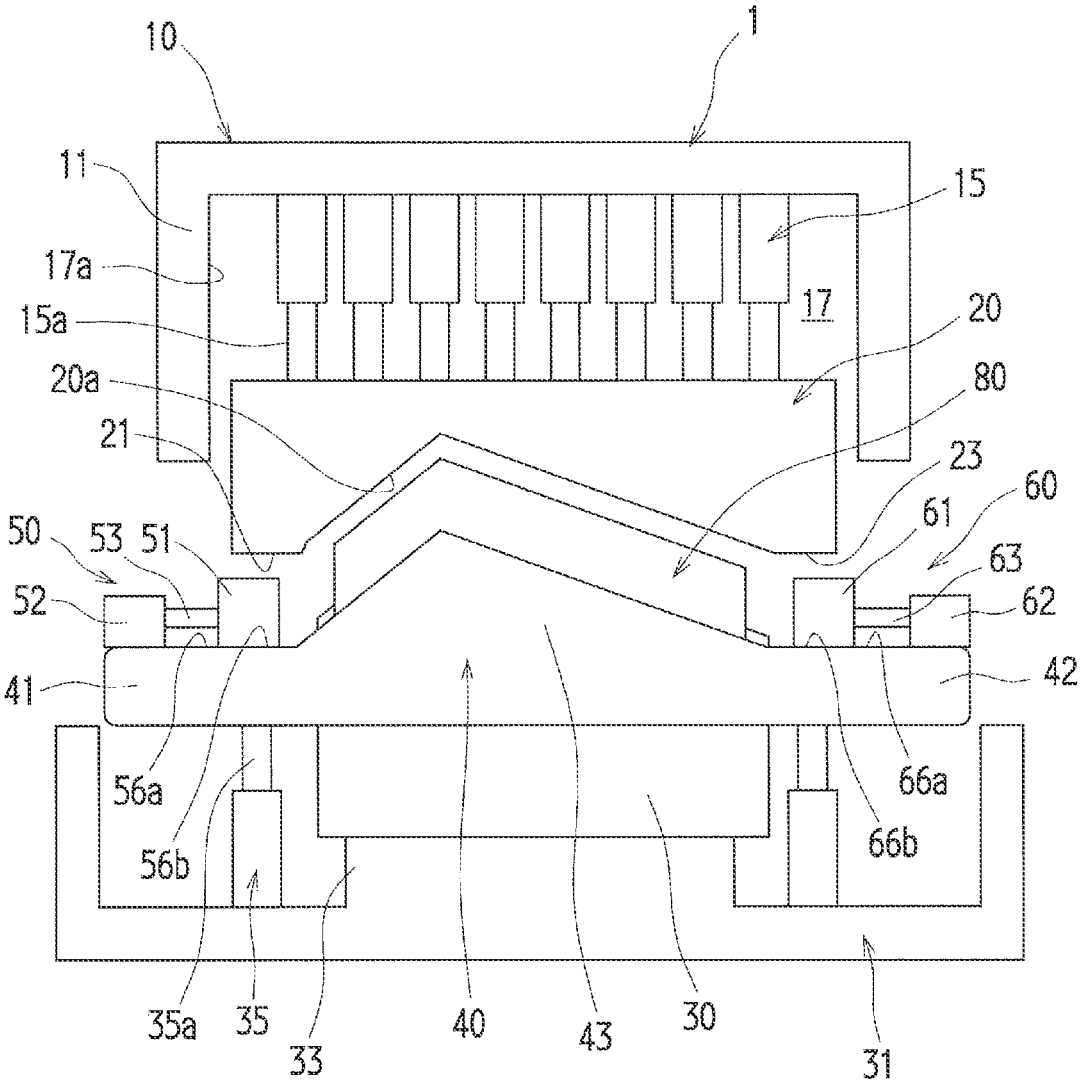
FIG. 16 is a schematic vertical sectional view of the manufacturing procedure 6 for the component having the hat-shaped section.

FIG. 11 and FIG. 12 are a lateral sectional view and a vertical sectional view, respectively, schematically showing a manufacturing procedure 4 according to the embodiment. FIG. 13 and FIG. 14 are a lateral sectional view and a vertical sectional view, respectively, schematically showing a manufacturing procedure 5 according to the embodiment. FIG. 15 and FIG. 16 are a lateral sectional view and a vertical sectional view, respectively, schematically showing a manufacturing procedure 6 according to the embodiment.

When the component having the hat-shaped section 80 is manufactured, as described above, first of all, as shown in FIG. 5, the metal plate 70 curved into the almost inverse V-shape along the longitudinal direction is placed on the punch 30 and the holder 40. At this time, as shown in FIG. 6, the locking blocks 51, 61 are positioned at the non-facing positions 56*a*, 66*a*, respectively, so that they do not interrupt a descent of the pad 20.

Next, as the slide of the press machine is driven so as to lower the die 10, as shown in FIG. 7, the central lower surface 20*a* of the pad 20 and the upper surface 30*a* of the punch 30 sandwich the center portion 71 of the metal plate 70 in the upper-lower direction, and the lower end surface 13*a* of the die piece 13 and the upper surfaces 46*a* of the side edge portions 46 sandwich both side portions 75 of the metal plate 70 in the upper-lower direction. At this time, as shown in FIG. 8, the locking blocks 51, 61 are also at the non-facing positions 56*a*, 66*a*, respectively.

Then, the pad 20 and the punch 30 that sandwich the center portion 71 of the metal plate 70 in the upper-lower direction, and the die 10 and the holder 40 that sandwich the both side portions 75 of the metal plate 70 in the upper-lower direction are moved relative to each other in the upper-lower direction. Thus, as shown in FIG. 9, at the bottom dead point of forming (a state where the slide of the press machine is lowered most), the component having the hat-shaped section 80 is formed. At this time, the locking blocks 51, 61 are also at the non-facing positions 56*a*, 66*a*, respectively, as shown in FIG. 10.

Then, after the mold closing when the slide of the press machine is lowered most, also before the mold opening when the component having the hat-shaped section 80 is released from the mold and taken out, the locking blocks 51, 61 are moved from the non-facing positions 56*a*, 66*a* to the facing positions 56*b*, 66*b*, respectively, as shown in FIG. 12. Then, the locking block 51 is inserted between the first lower surface 21 of the pad 20 and the first portion 41 of the holder 40, and the locking block 61 is inserted between the second lower surface 23 of the pad 20 and the second portion 42 of the holder 40. Even after the locking blocks 51, 61 are inserted between the pad 20 and the holder 40 as described above, there is no change in the positional relationship between the pad 20 and the holder 40 in the upper-lower direction as evident from a comparison between FIG. 9 and FIG. 11.

Here, if the air cylinders 52, 62 that move the locking blocks 51, 61, respectively, are provided outside the holder 40, adjustment of positions of the air cylinders 52, 62 and the locking blocks 51, 61, respectively, in the upper-lower direction becomes complex. In this regard, in the embodiment, since not only the locking blocks 51, 61 but also the air cylinders 52, 62 are provided on the holder 40, it is possible to easily move the locking blocks 51, 61 on the holder 40 in the horizontal direction without a need of positioning the air cylinders 52, 62 and the locking blocks 51, 61, respectively, in the upper-lower direction.

Next, as shown in FIG. 13, when the slide of the press machine is driven so as to elevate the die 10, the punch 30 moves away from the lower surface of the top plate 81, and, at the same time, the holder 40 is elevated by the energizing force from the nitrogen gas cylinders 35. At this time, as shown in FIG. 14, the locking blocks 51, 61 receive both pressurizing force from the pad 20 caused by the energizing force of the nitrogen gas cylinders 15 (see outlined arrows), and pressurizing force from the holder 40 caused by the energizing force from the nitrogen gas cylinders 35 (see black arrows). Therefore, the pressurizing force from the pad 20 and the holder 40 does not act on the top plate 81 and the flanges 85. As described above, because the locking blocks 51, 61 are inserted between the pad 20 and the holder 40, the positional relationship between the pad 20 and the holder 40 in the upper-lower direction in the mold closed state (at the bottom dead point of forming) is maintained even during the mold opening. Therefore, it is possible to inhibit compression of the component having the hat-shaped section 80 in the upper-lower direction caused by pressurizing force from the pad 20 and the holder 40.

Then, when the holder 40 is elevated most, in other words, when the upper surfaces 46*a* of the side edge portions 46 are flush with the upper surface 30*a* of the punch 30, the first lower surface 21 and the second lower surface 23 of the pad 20 start to move away from the locking blocks 51, 61. Simultaneously, the central lower surface 20*a* of the pad 20 is moved away from the top plate 81. Therefore, the pressurizing force from the pad 20 caused by the energizing force does not act on the top plate 81 from above.

Therefore, as shown in FIG. 15 and FIG. 16, it is possible to release the component having the hat-shaped section 80 from the mold without causing deformation of the component having the hat-shaped section 80. Thus, after mold release of the component having the hat-shaped section 80 is completed, the locking blocks 51, 61 are moved from the facing positions 56*b*, 66*b* to the non-facing positions 56*a*, 66*a*, respectively, so as to return to the state shown in FIG. 5 and FIG. 6 in preparation for forming of the next component having the hat-shaped section 80, in other words, after the mold opening and before the mold closing.

Actions and Effects

As described so far, according to the embodiment, the locking blocks 51, 61 provided so as to be movable on the holder 40 in the horizontal direction are moved from the non-facing positions 56*a*, 66*a* to the facing positions 56*b*, 66*b*, respectively, and the locking blocks 51, 61 are inserted between the pad 20 and the holder 40. With such a simple configuration, the positional relationship between the pad 20 and the holder 40 in the mold closing state is maintained even during the mold opening. Therefore, it is possible to inhibit compression of the component having the hat-shaped section 80 in the upper-lower direction by pressurizing force from the pad 20 and the holder 40.

Further, because the air cylinders 52, 62 that move the locking blocks 51, 61, respectively, are provided on the holder 40, it is possible to easily move the locking blocks 51, 61 on the holder 40 in the horizontal direction without a need of positioning of the air cylinders 52, 62 and the locking blocks 51, 61 in the upper-lower direction, respectively. Thus, it is possible to manufacture the component having the hat-shaped section 80 smoothly.

Other Embodiments

The disclosure is not limited to the foregoing embodiment, and may be carried out in various other modes without departing from the spirit and main characteristics of the disclosure.

In the foregoing embodiment, the die 10 and the pad 20 are provided on the upper side, and the holder 40 and the punch 30 are provided on the lower side. However, the disclosure is not limited to this, and the die 10 and the pad 20 may be provided on the lower side, and the holder 40 and the punch 30 may be provided on the upper side.

Also, in the foregoing embodiment, a pressing direction is the upper-lower direction. However, the disclosure is not limited to this, and the pressing direction may be the right-left direction.

Further, in the foregoing embodiment, the energizing force is applied to the pad 20 and the holder 40 by the nitrogen gas cylinders 15, 35, respectively. However, the disclosure is not limited to this. For example, energizing force may be applied to the pad 20 and the holder 40 with use of a spring (not shown).

As described so far, the foregoing embodiment is only an example in every aspect, and should not be interpreted narrowly. Further, all deformations and changes that belong to a scope equivalent to the scope of the claims are within the scope of the disclosure.

According to the disclosure, it is possible to inhibit deformation of the component having the hat-shaped section at the time of mold release with the simple configuration. Therefore, it is extremely beneficial when the disclosure is applied to the manufacturing device and the manufacturing method for the component having the hat-shaped section.

What is claimed is:

1. A manufacturing device for a component having a hat-shaped section, the manufacturing device manufacturing the component having the hat-shaped section as a pad and a punch that sandwich a center portion of a metal plate in a first direction, and a die and a holder that sandwich both side portions of the metal plate in the first direction are moved relative to each other in the first direction so that the center portion serves as a top plate, the both side portions serve as flanges, respectively, and portions stretched between the center portion and the both side portions serve as vertical walls, respectively, the manufacturing device comprising:

the die in which an die opening is formed, the die opening being open on a first side in the first direction;

the pad that has a maximum cross section, when viewed in the first direction, that is provided entirely inside the die opening so that the pad is able to move relative to the die to a second side in the first direction against energizing force towards the first side in the first direction;

the punch that is arranged to face the pad in the first direction so as to sandwich the center portion;

the holder that is provided around the punch, the holder facing the die in the first direction so as to sandwich the both side portions, and being able to move to the first side in the first direction against energizing force towards the second side in the first direction; and a locking block that is provided on a part of the holder on the second side in the first direction, and is able to move a second direction orthogonal to the first direction, the second direction being parallel to a longitudinal axis of the hat-shaped section when the hat-shaped section is being formed, wherein:

the locking block is configured to be moved from a position on the holder, the position not facing the pad in the first direction, to a position on the holder, the position facing the pad in the first direction, so that the locking block is inserted between the holder and the pad after the hat-shaped section is formed, and a positional relationship between the holder and the pad in a mold closed state is thus maintained even during mold opening, the holder includes:

a first portion positioned in a portion of the holder on a first side in the second direction, a second portion positioned in a portion of the holder on a second side in the second direction;

a third portion positioned between the first portion and the second portion, the third portion comprising:

a holder opening that penetrates the third portion in the first direction;

end portions in a third direction orthogonal to the first and second directions, and side edge portions of the holder opening having upper surfaces that are a step higher than upper surfaces of the end portions, the upper surfaces of the side edge portions being configured as molding surfaces that pressurize the side portions of the metal plate at the time that the pad and punch and the die and holder are moved relative to each other in the first direction; and a plurality of distance blocks extending upwardly from each of the upper surfaces of both end portions of the third portion at intervals in the second direction.

2. The manufacturing device for the component having the hat-shaped section according to claim 1, the manufacturing device further comprising a driving unit that is provided on a part of the holder on the second side in the first direction, the driving unit being configured to move the locking block in the second direction.

3. A manufacturing method for a component having a hat-shaped section, the manufacturing method being used to manufacture the component having the hat-shaped section from a metal plate using a manufacturing device including:

a die in which a die opening is formed, the die opening being open on a first side in a first direction, a pad that has a maximum cross section, when viewed in the first direction, that is provided entirely inside the die opening so that the pad is able to move relative to the die to a second side in the first direction against energizing force towards the first side in the first direction, a punch that is arranged to face the pad in the first direction, a holder that is provided around the punch, the holder facing the die in the first direction and being able to move to the first side in the first direction against energizing force towards the second side in the first direction, and a locking block that is provided on a part of the holder on the second side in the first direction, and is able to move in a second direction orthogonal to the first direction, the second direction being parallel to a longitudinal axis of the hat-shaped section when the hat-shaped section is being formed, the manufacturing method comprising:

a step of forming the component having the hat-shaped section as the pad and the punch that sandwich a center portion of the metal plate in the first direction, and the die and the holder that sandwich both side portions of the metal plate in the first direction are moved relative to each other in the first direction due to mold closing so that the center portion serves as a top plate, the both side portions serve as flanges, respectively, and portions stretched between the center portion and the both side portions serve as vertical walls, respectively;

a step of inserting the locking block between the holder and the pad as the locking block is moved from a position on the holder, the position not facing the pad in the first direction, to a position on the holder, the position facing the pad in the first direction, after the mold closing and also before mold opening such that a positional relationship between the pad and the holder in a mold closed state is maintained even during the mold opening; and a step of moving the locking block from the position on the holder, the position facing the pad in the first direction, to the position on the holder, the position not facing the pad in the first direction, after the hat-shaped section is formed, after the mold opening, and before mold closing, wherein:

the holder includes:

a first portion positioned in a portion of the holder on a first side in the second direction;

a second portion positioned in a portion of the holder on a second side in the second direction;

a third portion positioned between the first portion and the second portion, the third portion comprising:

a holder opening that penetrates the third portion in the first direction;

end portions in a third direction orthogonal to the first and second directions; and side edge portions of the holder opening having upper surfaces that are a step higher than upper surfaces of the end portions; and a plurality of distance blocks extending upwardly from each of the upper surfaces of both end portions of the third portion at intervals in the second direction, and during the step of forming the component having the hat-shaped section, the upper surfaces of the side edge portions of the holder pressurize the side portions of the metal plate.

4. The manufacturing device for the component having the hat-shaped section according to claim 1, wherein the locking block is configured to be moved from the position on the holder where the locking block is not facing the pad in the first direction to the position on the holder where the locking block is facing the pad in the first direction after the hat-shaped section is completely formed.

5. The manufacturing method for a component having a hat-shaped section according to claim 3, wherein the locking block is moved from the position on the holder where the locking block is not facing the pad in the first direction to the position on the holder where the locking block is facing the pad in the first direction after the hat-shaped section is completely formed.

6. The manufacturing device for the component having the hat-shaped section according to claim 1, wherein the pad has an approximately rectangular parallelepiped shape.

7. The manufacturing device for the component having the hat-shaped section according to claim 1, wherein the locking block is configured to be linearly moved from the position on the holder not facing the pad in the first direction, to the position on the holder facing the pad in the first direction.

8. The manufacturing method for a component having a hat-shaped section according to claim 3, wherein the pad has an approximately rectangular parallelepiped shape.

9. The manufacturing method for a component having a hat-shaped section according to claim 3, wherein the step of inserting the locking block between the holder and the pad comprises linearly moving the locking block from the position on the holder not facing the pad in the first direction, to the position on the holder facing the pad in the first direction.

10. The manufacturing device for the component having the hat-shaped section according to claim 1, wherein an upper surface of the third portion is curved in the second direction.

11. The manufacturing method for a component having a hat-shaped section according to claim 3, wherein an upper surface of the third portion is curved in the second direction.

* * * * *